United States Patent [19]

Dehne et al.

[11] Patent Number: 4,984,523

[45] Date of Patent: Jan. 15, 1991

[54] SELF-PROPELLED TROLLEY AND SUPPORTING TRACK STRUCTURE

[75] Inventors: Clarence A. Dehne, Farmington Hills; Daniel S. Ellens, Brighton, both of Mich.

[73] Assignee: Jervis B. Webb Company, Farmington Hills, Mich.

[21] Appl. No.: 281,192

[22] Filed: Dec. 7, 1988

[51] Int. Cl.[5] ..... B61B 3/00; E01B 25/22

[52] U.S. Cl. ..... 105/155; 104/95; 191/34

[58] Field of Search ..... 191/34, 38, 22, 20, 191/45 R; 104/103, 95; 105/155, 54

[56] References Cited

PUBLICATIONS

Société Lyonnaise, Des Eaux et de, L'Eclairage Safege "Overhead suspended rapid transit" chapters 6–9 pp. 1–36.

*Primary Examiner*—Sherman Basinger

*Assistant Examiner*—Virna Lissi Mojica

*Attorney, Agent, or Firm*—Joseph W. Farley

[57] ABSTRACT

A self-propelled trolley and supporting track structure, the trolley forming a housing for a four wheel drive mechanism which is coupled to a driving motor attached to the housing and to a pair of axles each equipped with a pair of driving and supporting wheels adapted to engage transversely spaced track surfaces of the track structure. The track structure comprises a pair of transversely spaced channel section track members, each having upper and lower flanges terminating in guide surfaces and connected by a vertical web, the guide surfaces of one track member facing the guide surfaces of the other. The track surface are formed by the upper flanges of the track members and the guide surfaces are engageable by pairs of guide wheels appended to the trolley below the housing. A conductor bar assembly enclosed within the track members is engaged by collector shoes attached to the trolley.

16 Claims, 2 Drawing Sheets

SELF-PROPELLED TROLLEY AND SUPPORTING TRACK STRUCTURE

SUMMARY OF THE INVENTION

This invention relates to improvements in a self-propelled trolley and track structure of the type employed in electrified monorail systems for industrial material handling and work processing systems, and particularly to a self-propelled trolley adapted for use in a system in which the articles or loads being handled are carried above the track structure that supports the trolley.

The invention provides a trolley having four supporting and driving wheels among which the weight of a load being handled is substantially equally distributable for optimum traction, together with a track structure having track surfaces located above vertically spaced guide surfaces engageable by guide wheels of the trolley for lateral stability thereof, the track structure forming an enclosure for the electrification components required to provide power to a drive motor of the trolley.

A self-propelled trolley of the invention is adapted to travel on track structure having a pair of trolley supporting track surfaces arranged on either side of a longitudinal centerline. The trolley comprises a trolley body forming an enclosed housing which includes longitudinally spaced end walls and transversely spaced side walls. Rotatably carried by the trolley body is a pair of longitudinally spaced, transversely extending axles each having a central portion disposed within the housing and opposite end portions projecting from the housing side walls. A pair of wheels adapted to engage the supporting track surfaces is mounted on the end portions of each axle for rotation therewith. A longitudinally extending drive shaft is rotatably supported by the trolley body within the housing, is operably connected by driving means to each of the axles, and is coupled to a drive motor attached to a motor adapter flange mounted on one end wall of the trolley body housing.

Preferably, the driving means comprises a pair of longitudinally spaced worm gears on the drive shaft and a pair of opinions each mounted on the central portion of one of the axles and engaging one of the worm gears.

A load carrier attachment fitting provided on an upper wall of the housing is centered longitudinally between the pair or axles and transversely between the pairs of wheels so that the weight of a load carrier attached to the fitting, together with the weight of any load supported by the load carrier is distributable substantially equally among the wheels.

The preferred trolley supporting track structure of the invention comprises a pair of channel section track members, each having upper and lower flanges connected by a vertical web and terminating in vertically spaced guide surfaces, the guide surfaces of one track member being positioned in facing relation with the guide surfaces of the other track member, and the upper flanges of the track members forming the pair of trolley supporting track surfaces. The trolley body is provided with a tab portion which is adapted to project downwardly between the track members and to which are connected oppositely facing, longitudinally extending guide roller supporting brackets, each bracket carrying a pair of vertically spaced guide rollers rotatable on a vertical axis perpendicular to one of the axles and engageable with the vertically spaced guide surfaces of the track members.

The facing channel section track members form an enclosure for a conductor bar assembly which is mounted within one of the track members on its vertical web, and which is contacted by a collector shoe unit connected to one of the guide roller supporting brackets.

Other features and advantages of the invention will appear from the detailed description to follow of the embodiment illustrated in the accompanying drawings.

DETAILED DESCRIPTION

Figure 1:
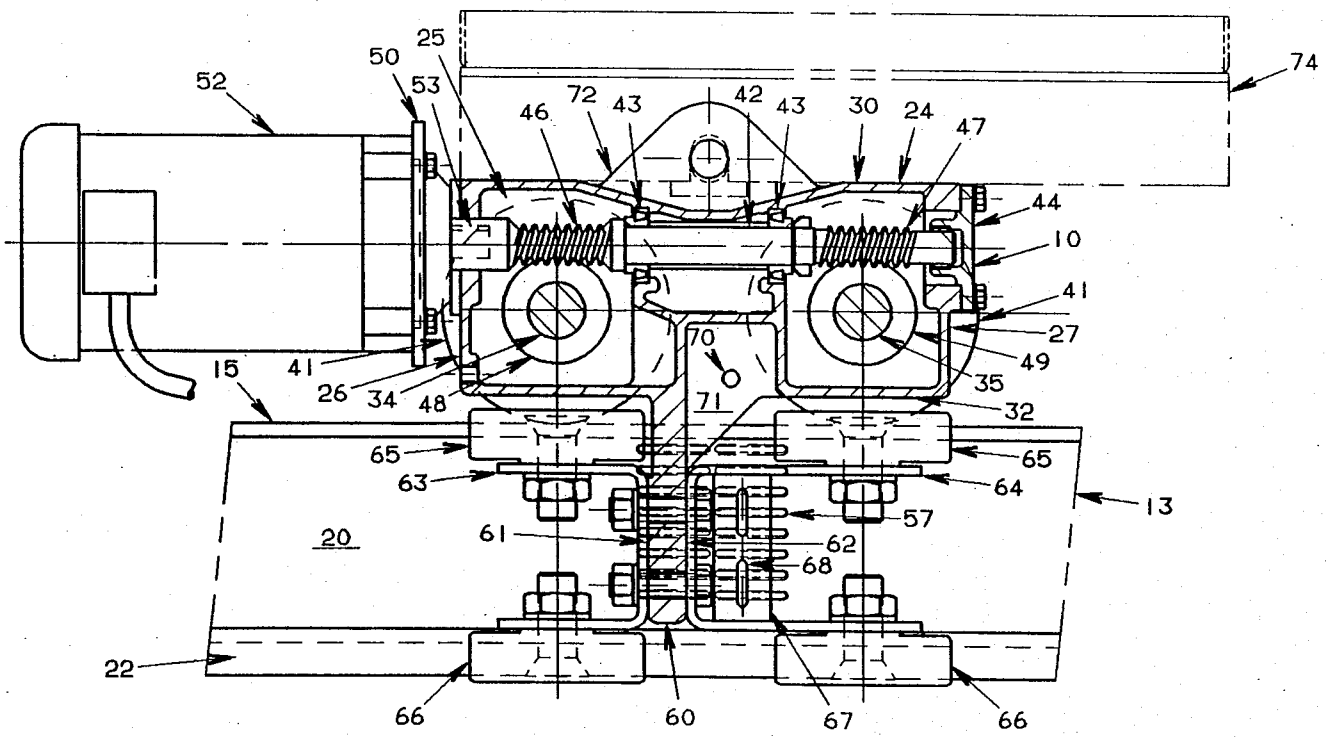
FIG. 1 is a side elevation, partly in section, showing in full line a self-propelled trolley of the invention together with the far-side supporting track member of FIG. 3, and including in broken line a representative load carrier attached to the trolley.
Figure 2:
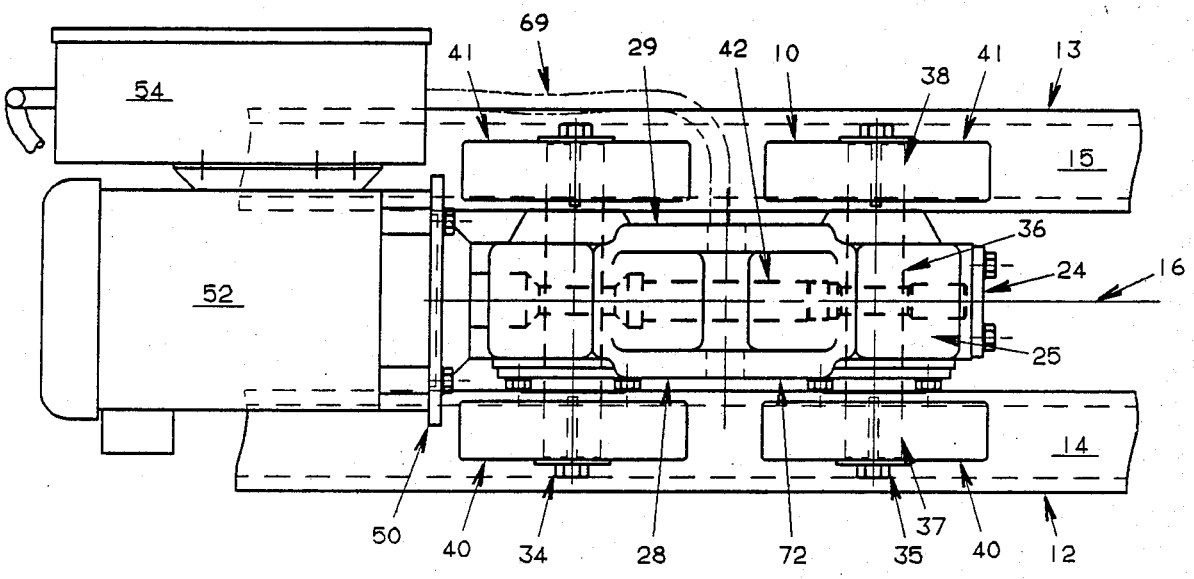
FIG. 2 is a plan view of the trolley of FIG. 1, showing the supporting track structure but not the load carrier.
Figure 3:
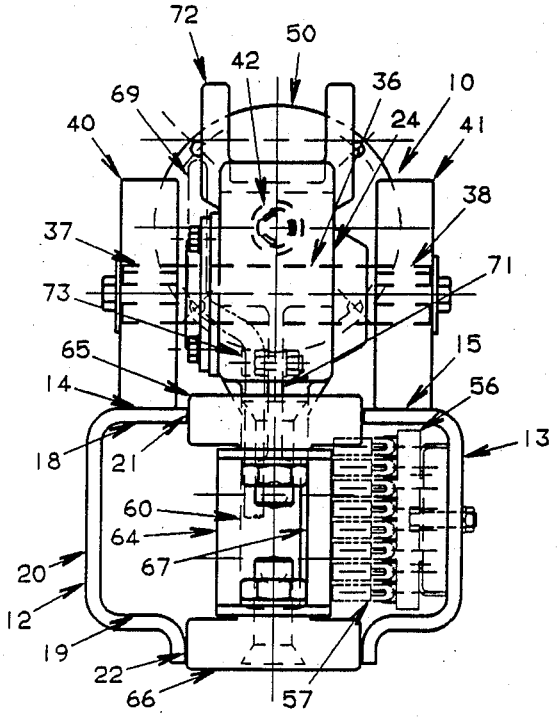
FIG. 3 is an end elevation of the trolley and track structure.

As shown in FIGS. 1–3, a self-propelled trolley 10 of the invention is adapted to travel on track structure formed by a pair of track members 12 and 13 providing a pair of trolley supporting track surfaces 14 and 15 transversely spaced to either side of a longitudinal centerline 16 (FIG. 2). Each of the track members 12 and 13 is a channel section member (FIG. 3) having upper and lower flanges 18 and 19 connected by a vertical web 20 and terminating in vertically spaced upper and lower guide surfaces 21 and 22, the guide surfaces of one track member facing the guide surfaces of the other track member. The upper flanges 18 form the trolley supporting track surfaces 14 and 15.

The self-propelled trolley 10 comprises a body 24 which forms an enclosed drive mechanism housing 25 defined by longitudinally spaced end walls 26 and 27, transversely spaced side walls 28 and 29, a top wall 30 and a bottom wall 32. Rotatably carried by the body 24 is a pair of axles 34 and 35 each having a central portion 36 disposed within the housing 25 and opposite ends 37 and 38 projecting from the housing side walls 28 and 29. A pair of trolley supporting and driving wheels 40 and 41 is mounted on each of the axles 34 and 35, each wheel being keyed to one of the axle ends for rotation therewith.

The drive mechanism includes a drive shaft 42 which extends within the housing 25 between the end walls 26 and 27, is journalled in suitable intermediate bearings 43 and an end bearing 44, and is formed with a pair of worm gears 46 and 47. Pinions 48 and 49, each mounted on the central portion 36 of one of the axles 34 and 36, engage the worm gears 46 and 47. A motor adapter flange 50 is attached to the housing end wall 26. A drive motor 52 is mounted on the adapter flange 50 and has an output shaft 53 coupled to the drive shaft 42 within a socket at the input end thereof, as shown in FIG. 1. A control box 54 (FIG. 2) is mounted on one side of the motor 52. Electrical power for the motor 52 is obtained from a conductor bar assembly 56 (FIG. 3), mounted within the channel section track member 13 on the vertical web 20 thereof through a collector shoe unit 57 appended to the trolley 10, as described below.

Formed with and depending from the trolley body 24 is a tab 60 which projects downwardly from the housing bottom wall 32 between the track members 12 and 13 and has a pair of opposed mounting surfaces 61 and 62 facing transversely to the housing side walls 28 and 29. Guide roller supporting brackets 63 and 64 are secured respectively to the mounting surfaces 61 and 62, and a pair of vertically spaced guide rollers 65 and 66 is carried by each of the brackets 63 and 64. Each pair of guide rollers 65 and 66 is rotatable on a vertical axis extending perpendicular to and substantially aligned with the axis of the drive shaft 42, is located below one of the axles 34 and 35, and is engageable with the upper and lower guide surfaces 21 and 22 of the track members 12 and 13. As shown in FIG. 1, the tab 60 is offset longitudinally of the trolley body 24 toward one of the axles 34, and the U-shaped guide roller supporting bracket 64 which extends toward the other axle 35 includes a longitudinally extending vertical plate 67 provided with slots 68 for attaching the collector shoe assembly 57 thereto in substantially longitudinally centered relation between the pairs of guide rollers 65 and 66. A cable 69, schematically shown in FIG. 2, connects the control box 54 to the collector shoe unit 57, is actually placed along one side of the trolley body, as indicated in FIG. 3, and is positioned by a clip 73 anchored in a hole 70 (FIG. 1) of a transversely centered web 71 formed with the tab 60.

A clevis-type load attachment fitting 72 is formed with the trolley body 24 and projects upwardly from the top wall 30 thereof in longitudinally centered relation to the axles 34 and 35. A load carrier 74 is connected to the fitting 72 and is indicated only schematically in FIG. 1, since the load carrier in practice will be designed to suit the size and configuration of the particular load to be handled. FIG. 1 illustrates the feature that the placement of the attachment 72 is such as to permit a substantially equal distribution of the weight of the load among all of the four trolley supporting and driving, wheels 40, 41; and to promote such equal weight distribution, the load carrier 74 illustrated extends longitudinally of the trolley body 24 oppositely to the drive motor 52 so that the weight of the load tends to balance the weight of the drive motor.

An application of the invention to the handling of large size loads may require the use of a second, non-powered trolley provided with a similar load attachment fitting 72, and the use of a suitable load carrier connected between the attachment fittings of this second trolley and the trolley 10 shown.

From the foregoing description it will be appreciated that the invention provides a self-propelled trolley 10 having the features of four supporting and driving wheels and an extremely compact construction obtained by employing the trolley body 24 as a reducer, or housing within which the drive transmitting mechanism is contained. Superior lateral stability of the trolley 10, desirable for load carriers located above the trolley supporting tracks, is obtained by the vertically spaced upper and lower guide surfaces 21 and 22 of the track members 12 and 13 and the engageability of those guide surfaces by the vertically space pairs of guide rollers 65 and 66. The opposed channel configuration of the track members 12 and 13 provides relatively enclosed protection for the conductor bar unit 56 and the collector shoe assembly 57.

A further feature of the track configuration is that it permits a disabled trolley 10 to be readily lifted off of the track members 12 and 13, once the collector shoe assembly 57 has been disconnected. A disabled trolley 10 can be very difficult to move along the track to a repair station, thus requiring, in track configurations which enclose or partially enclose the trolley wheels, the provision of access gates in the track to permit trolleys to be removed. Alternatively, trolley removal may require a section of track to be cut away.

We claim:

1. A self-propelled industrial material handling system trolley adapted to travel on track structure having a longitudinal centerline and a pair of trolley supporting track surfaces transversely spaced to either side of said longitudinal centerline, wherein said trolley comprises:

a trolley body forming a drive mechanism housing defined by longitudinally spaced end walls, transversely spaced side walls, and an upper wall extending between said side and end walls;

a pair of longitudinally spaced, transversely extending axles rotatably carried by said housing, each axle having a central portion disposed within said housing and opposite end portions projecting from said side walls;

a pair of wheels mounted on the end portions of each of said axles, each pair of wheels being adapted to engage said pair of supporting track surfaces;

a longitudinally extending drive shaft having opposite ends, said drive shaft being rotatably supported within said housing between said end walls, said pair of axles being located intermediate said drive shaft ends, and driving means for operably connecting said drive shaft to each of said axles;

a motor adapter flange mounted on one of said housing end walls;

a drive motor attached to said adapter flange and drivingly coupled to one end of said drive shaft; and load attachment means provided on said housing upper wall for supporting a load above said trolley body, the weight of such load being distributable substantially equally among said wheels.

2. A self-propelled industrial material handling system trolley comprising a trolley body forming a housing means for a drive mechanism, said housing means being defined by spaced apart side and end walls, and an upper wall extending between said side and end walls;

a pair of spaced parallel axles rotatably carried by said housing means and extending between the side walls thereof, each axle having a central portion disposed within said housing means and opposite end portions projecting from said side walls;

a trolley supporting and driving wheel attached to each of said axle end portions for rotation therewith;

said drive mechanism comprising a drive shaft journalled within said housing and extending between said end walls transversely to said axles, a pair of worm gears on said drive shaft, and a pinion mounted of the central portion of each axles and engaging one of said worm gears;

a motor adapter flange attached to one of said housing end walls, and a drive motor mounted on said adapter flange and coupled to said drive shaft;

load attachment means projecting upwardly from said upper wall of said housing means for connecting a load carrier to said trolley body, said load attachment means being centered longitudinally between said pair of axles for distributing the weight of a load substantially equally among said trolley supporting and driving wheels; and a tab portion projecting downwardly from said housing means, said tab portion having a pair of opposed mounting surfaces each facing transversely to said side walls, a guide roller supporting bracket secured to each of said mounting surfaces, and a pair of vertically spaced guide rollers carried by each guide roller supporting bracket for rotation on a vertical axis perpendicular to one of said axles.

3. A self-propelled trolley adapted to travel on track structure having a longitudinal centerline and a pair of trolley supporting track surfaces transversely spaced to either side of said longitudinal centerline, wherein said track structure comprises a pair of transversely spaced channel section track means each having upper and lower flanges connected by a vertical web and terminating in vertical guide surfaces positioned in facing relation, said upper flanges forming said pair of trolley supporting track surfaces;

said trolley comprising:

a trolley body forming a housing including longitudinally spaced end walls and transversely spaced side walls;

a pair of longitudinally spaced, transversely extending axles rotatably carried by said trolley body, each axle having a central portion disposed within said housing and opposite end portions projecting from said side walls;

a pair of wheels mounted on the end portions of each of said axles, each pair of wheels being adapted to engage said pair of supporting track surfaces;

a longitudinally extending drive shaft rotatably supported by said trolley body within said housing, and driving means for operably connecting said drive shaft to at least one of said axles;

a motor adapter flange mounted on one of said trolley body end walls;

a drive motor attached to said adapter flange and drivingly coupled to said drive shaft; and guide roller means carried by said trolley body for engaging said guide surfaces, said guide roller means comprising a vertically spaced pair of guide rollers located below each of said pair of axles and engageable with said facing vertical guide surfaces at the ends of the upper and lower flanges of said track members.

4. A self-propelled trolley according to claim 1 wherein said driving means comprises a pair of longitudinally spaced worm gears on said drive shaft and a pair of pinions, each pinion being mounted on the central portion of one of said pair of axles and engaging one of said pair of worm gears.

5. A self-propelled trolley according to claim 1 wherein said load attachment means is centered longitudinally between said pair of axles.

6. A self-propelled trolley according to claim 5 further comprising a load carrier connectable to said load attachment means, said load carrier extending longitudinally of said trolley body oppositely to said drive motor.

7. A self-propelled trolley according to claim 1 wherein in said track structure includes transversely spaced guide surfaces, and guide roller means carried by said trolley body for engagement with said guide surfaces.

8. A self-propelled trolley according to claim 7 wherein said guide roller means is mounted on a rotational axis extending perpendicular to and substantially aligned with the axis of said drive shaft.

9. A self-propelled trolley according to claim 1 wherein said track structure comprises a pair of transversely spaced track members having upwardly facing upper surfaces forming said pair of trolley supporting track surfaces and having at least one pair of transversely spaced guide surfaces disposed below said upper surfaces perpendicularly thereto, and guide roller means carried by said trolley body for engagement with said guide surfaces.

10. A self-propelled trolley according to claim 9 wherein said guide roller means comprises a pair of longitudinally spaced guide rollers having rotational axes perpendicular to said pair of axles.

11. A self-propelled trolley according to claim 9 wherein said guide roller means includes at least one guide roller disposed below each of said axles and rotatable on an axis perpendicular thereto.

12. A self-propelled trolley according to claim 2 wherein said trolley body is provided with a tab portion extending downwardly between said track members, and a bracket supporting each vertically spaced pair of guide rollers, each bracket being connected to said tab portion.

13. A self-propelled trolley according to claim 12 further comprising conductor bar means mounted within one of said channel section track members on the said vertical web thereof, and collector shoe means carried by said trolley body for engagement with said conductor bar means.

14. A self-propelled trolley according to claim 13 wherein said collector shoe means is connected to one of said guide roller supporting brackets.

15. A self-propelled trolley according to claim 13 wherein said driving means operably connects said drive shaft to each of said axles.

16. A self-propelled trolley according to claim 15 wherein said driving means comprises a pair of longitudinally spaced worm gears on said drive shaft and a pair of pinions, each pinion being mounted on the central portion of one of said pair of axles and engaging one of said pair of worm gears.

* * * * *

UNITED STATES PATENT AND TRADEMARK OFFICE

CERTIFICATE OF CORRECTION

PATENT NO. : 4,984,523

DATED : January 15, 1991

INVENTOR(S) : Clarence A. Dehne et al.

It is certified that error appears in the above-identified patent and that said Letters Patent is hereby corrected as shown below:

Title page:
Abstract, line 12, "surface" should read --surfaces--

Column 4, line 57, "of" should read --on--

Column 5, Claim 3, line 14, "means" should read --members--

Signed and Sealed this

Fifth Day of May, 1992

*Attest:*

DOUGLAS B. COMER

*Attesting Officer*

*Acting Commissioner of Patents and Trademarks*